US009024596B2

(12) United States Patent
Brueckl et al.

(10) Patent No.: US 9,024,596 B2
(45) Date of Patent: May 5, 2015

(54) TAP CHANGER

(75) Inventors: Oliver Brueckl, Waldmuenchen (DE); Udo Hertel, Regensburg (DE); Armin Hirthammer, Regensburg (DE); Anatoli Saveliev, Zeitlarn (DE)

(73) Assignee: Maschinenfrabrik Reinhausen GmbH, Regensburg (DE)

( * ) Notice: Subject to any disclaimer, the term of this patent is extended or adjusted under 35 U.S.C. 154(b) by 417 days.

(21) Appl. No.: 13/575,878

(22) PCT Filed: Dec. 23, 2010

(86) PCT No.: PCT/EP2010/007934

§ 371 (c)(1),
(2), (4) Date: Aug. 21, 2012

(87) PCT Pub. No.: WO2011/103908

PCT Pub. Date: Sep. 1, 2011

(65) Prior Publication Data

US 2012/0313594 A1 Dec. 13, 2012

(30) Foreign Application Priority Data

Feb. 24, 2010 (DE) ..... 10 2010 008 973

(51) Int. Cl.

| | |
|---|---|
| ***G05F 1/16*** | (2006.01) |
| ***H01F 29/04*** | (2006.01) |
| ***H01H 9/00*** | (2006.01) |
| *H01H 9/54* | (2006.01) |

(52) U.S. Cl.

CPC ..... *H01H 9/0027* (2013.01); *H01H 9/541* (2013.01)

(58) Field of Classification Search

CPC . H01H 9/0005; H01H 9/0027; H01H 9/0016; H01H 9/541; H01H 9/542; H01H 9/547548; G05F 1/14; G05F 1/16; H01F 29/00; H01F 29/02; H01F 29/04

USPC ..... 323/255, 256, 258, 340, 343; 336/150; 200/11 TC; 327/108, 432–434

See application file for complete search history.

(56) References Cited

U.S. PATENT DOCUMENTS

| | | | | |
|---|---|---|---|---|
| 2009/0146637 | A1 * | 6/2009 | Stich et al. | 323/343 |
| 2011/0133817 | A1 * | 6/2011 | Brueckl et al. | 327/482 |

FOREIGN PATENT DOCUMENTS

| | | | |
|---|---|---|---|
| DE | 40772 | B | 8/1965 |
| EP | 0127904 | A | 11/1984 |
| WO | 0122447 | A | 3/2001 |
| WO | 02093600 | A | 11/2002 |

* cited by examiner

*Primary Examiner* — Matthew Nguyen
*Assistant Examiner* — Jye-June Lee
(74) *Attorney, Agent, or Firm* — Andrew Wilford

(57) ABSTRACT

A tap changer with semiconductor switching elements for uninterrupted switching between winding taps of a tapped transformer has two load branches connected with the winding taps of the tapped transformer and that each comprise a respective mechanical main contact that in stationary operation conducts current of the respective load branch and produces an electrical connection with a load shunt. Each load branch also has parallel to the respective main contact a series circuit consisting of a further respective mechanical contact as well as a respective semiconductor switch. These semiconductor switches are electrically connected together at a side remote from the respective contacts and lead to a mechanical transfer contact whose other side is connected with the load shunt. A connection of the main contacts as well as the further mechanical contacts is effected by a movable contact support.

4 Claims, 7 Drawing Sheets

TAP CHANGER

CROSS REFERENCE TO RELATED APPLICATIONS

This application is the US-national stage of PCT application PCT/EP2010/007934 filed 23 Dec. 2010, published 1 Sep. 2011 as WO2011/103908, and claiming the priority of German patent application 102010008973.7 itself filed 24 Feb. 2010.

FIELD OF THE INVENTION

The invention relates to a tap changer with semiconductor switching elements for uninterrupted switching between winding taps of a tapped transformer.

BACKGROUND OF THE INVENTION

A tap changer with semiconductor switching elements, which is constructed as a hybrid switch, is known from WO 2001/022447. This known tap changer has, as hybrid switch, a mechanical part and an electrical part. The mechanical part, which is the actual subject of WO 2001/022447, has mechanical switching contacts in each of which a central part is a movable slide contact that is moved along a contact guide rail connected with the star point by a motor drive and in that case connects stationary contact elements. The actual load changeover itself is carried out by two IGBTs each with four diodes in a Graetz circuit. This known concept of a hybrid switch is subject to high mechanical loading in order to ensure the necessary load changeover precisely at the zero transition of the load current.

A further IGBT switching device is known from WO 1997/005536 (U.S. Pat. No. 5,969,511), in which the taps of the regulating winding of a power transformer are connectable with a load shunt through a series circuit of two IGBTs. However, in this arrangement it is necessary to specially adapt the tap changer to the respective tapped transformer that is to be connected.

OBJECT OF THE INVENTION

The object of the invention is to provide a tap changer of the kind described above that is of simple construction and has a high level of functional reliability. Moreover, it is an object of the invention to provide a tap changer that is usable as standard apparatus for the most diverse tapped transformers without transformer-specific adaptation being needed.

SUMMARY OF THE INVENTION

The invention starts from two semiconductor switches, wherein each switch has two IGBTs in anti-parallel connection. Each individual IGBT is a varistor connected in parallel therewith. In that case, the varistor is so dimensioned that the varistor voltage is smaller than the maximum blocking voltage of the respective parallel IGBTs, but greater than the maximum instantaneous value of the tap voltage.

As is usual for tap changers of the hybrid type, the semiconductor switches are switchable on and off by mechanical contacts and are connectable with the load shunt.

BRIEF DESCRIPTION OF THE DRAWING

The invention is described in more detail in the following with reference to drawings in which.

SPECIFIC DESCRIPTION OF THE INVENTION

Figure 1:
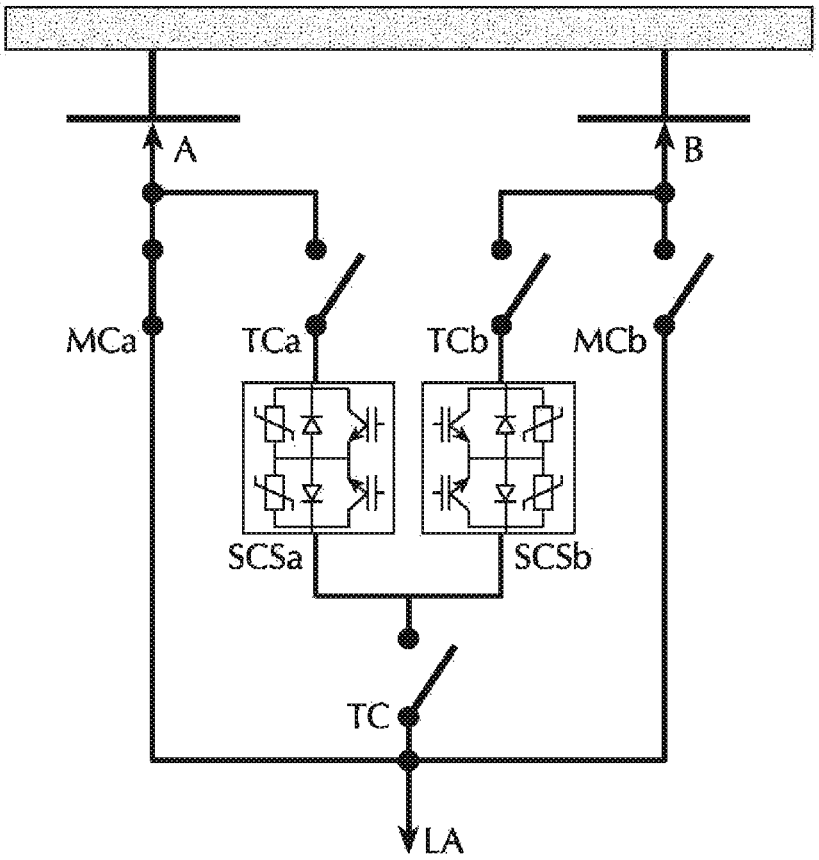
FIG. 1 shows a tap changer according to the invention in a schematic view.

FIG. 1 shows a tap changer according to the invention. Illustrated here are two load branches A and B that are connectable with two winding taps of a taped transformer by a respective mechanical contact. Each of the two load branches A and B has a mechanical main contact MCa or MCb that in stationary operation conducts the current of the respectively connected load branch and is produces a direct connection with a load shunt LA. Each load branch A and B has in parallel with the respective main contact MCa or MCb a series circuit consisting of a further mechanical contact TCa or TCb as well as a respective semiconductor switch SCSa, SCSb. The semiconductor switch units SCSa, SCSb are electrically connected together at the side remote from the respective switch contacts TCa, TCb and lead to a mechanical transfer contact TC, whose other side is connected with the load shunt LA. Thus, during the switching, which will be described in more detail further below, it is possible by appropriate actuation of the mechanical contact TCa or TCb as well as of the transfer contact TC to produce an electrical connection of each of the two load branches A and B through the respective semiconductor switch SCSa or SCSb with the load shunt LA.

Figure 1A:
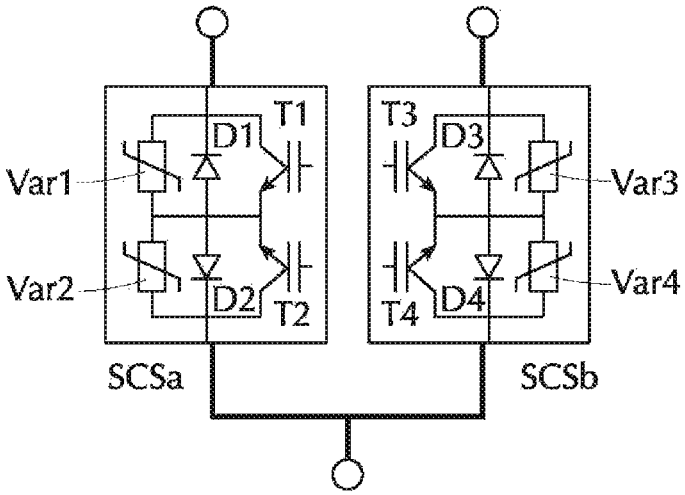
FIG. 1*a* shows an enlarged detail view of the semiconductor switches shown in FIG. 1.

FIG. 1*a* also shows the electronic subassemblies shown on the right in FIG. 1 and later also in the following FIG. 2, i.e. semiconductor switches SCSa, SCSb, in enlarged view. In that case, four IGBTs T1 . . . T4 are shown, of which two are connected in series with each other in each branch. In addition, a diode D1 . . . D4 is provided in parallel with each IGBT T1 . . . T4, the diodes (D1, D2; D3, D4) in each branch being connected relative to one another. Moreover, a respective varistor Var1 . . . Var4 is in addition connected in parallel therewith.

The two semiconductor switches SCSa, SCSb represent the actual semiconductor switch SCS. It consists, as already described, of the following components: in total four IGBTs T1 . . . T4 are provided, of which two are in each path. The IGBTs are activated in pairs. If the load branch or path A is the side switching off, initially the IGBTs T1 and T2 are switched on. Since the current direction at the switch-over instant is random, the IGBTs are connected in series relative to one another. During the switching to the other load branch or path B, the IGBTs 1 and 2 are switched off and the IGBTs of the other side are switched on almost simultaneously. Diodes D1 . . . D4 are provided in parallel with each IGBT T1 . . . T4. In addition, a respective varistor Var1 . . . Var4 is also connected in parallel therewith. These varistors serve for discharging or charging the stray impedances (stray inductances) of the transformer stage. It can be seen that the electrical circuit of the semiconductor switch SCS in each branch A or B is of identical construction and contains the described semiconductor switches SCSa and SCSb. The electrical combination can be seen in the lower part of FIG. 1*a*, which leads to the transfer contact TC described further above and not illustrated here.

Figure 2:
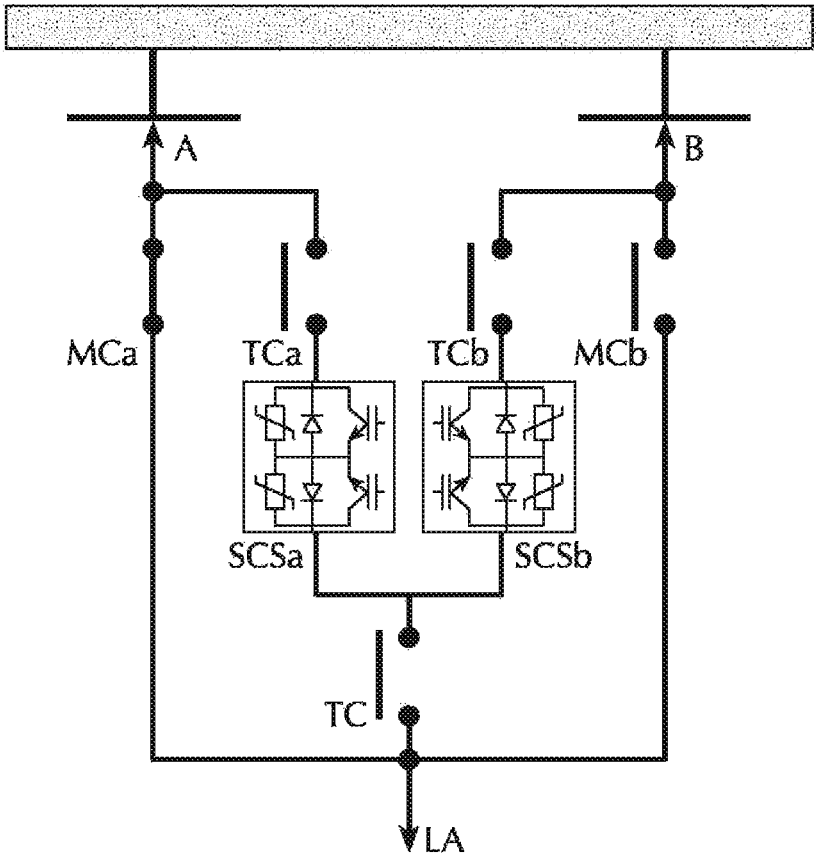
FIG. 2 shows a tap changer according to the invention in schematic view with an alternative contact construction.

FIG. 2 shows a tap changer according to the invention with, again, two load branches A and B. The already described mechanical contacts TCa, TCb and TC are here constructed as doubled interrupting contacts.

Figure 3:
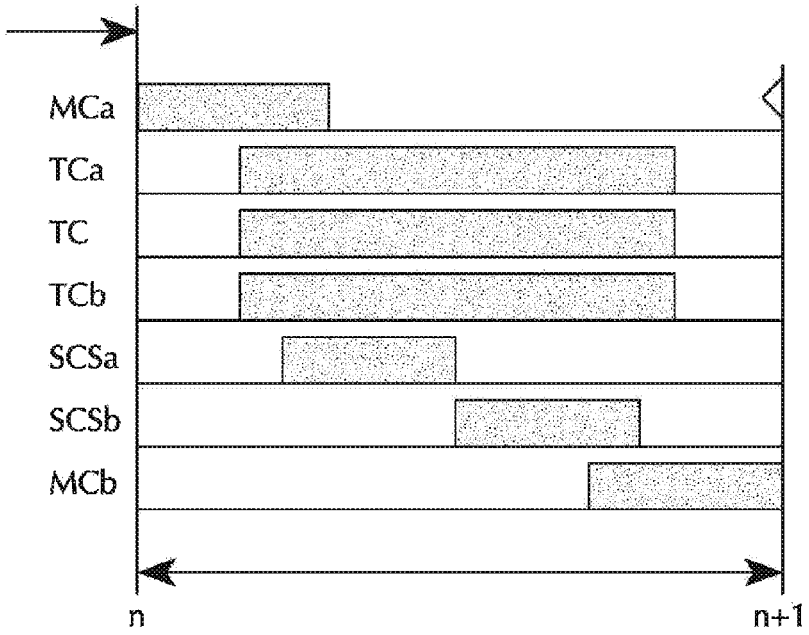
FIG. 3 shows a switching sequence for switching from one winding tap n to an adjacent winding tap n+1.

FIG. 3 shows a switching sequence for switching the tap changer from n to n+1. In that case, the following steps are executed:

Phase 1: Stationary operation at tap A. The current flows via the closed contact MCa to the load shunt LA. The semiconductor switches SCSa, SCSb remain switched off, since all other mechanical switches are open.

Phase 2: Switching-on of the electronic system. The mechanical contacts TCa, TCb and TC are switched on almost simultaneously. The semiconductor switch SCS is thus supplied with electrical energy by the tap voltage.

Phase 3: Switching-on of the semiconductor switching subassembly SCSa. Since the electrical resistance of the mechanical contact group is low compared with that of the semiconductor components and of the remaining electronic components, the current is initially still conducted through the mechanical contact MCa.

Phase 4: Opening of the main contact MCa. The current is thereby conducted through the semiconductor switch SCSa.

Phase 5: The electronic system switches over. The semiconductor switch SCSa is switched off; the semiconductor switch SCSb is switched on and takes over conducting of current.

Phase 6: The mechanical contact MCb of the other side B is switched on and now takes over conducting the current.

Phase 7: Switching-off of the semiconductor switch SCSb. As soon as the mechanical contact MCb is closed, the electronic system switches off the semiconductor switch SCSb of this branch.

Phase 8: Switching-off of the entire electronic system. The mechanical contacts TCa, TCb and TC are for that purpose switched off almost simultaneously. All electronic components are isolated from the voltage supply, i.e. the tap voltage. The load current is conducted from the side B via the closed mechanical main contact MCb directly to the load shunt LA. The switching is concluded; the new static state is reached.

Figure 4:
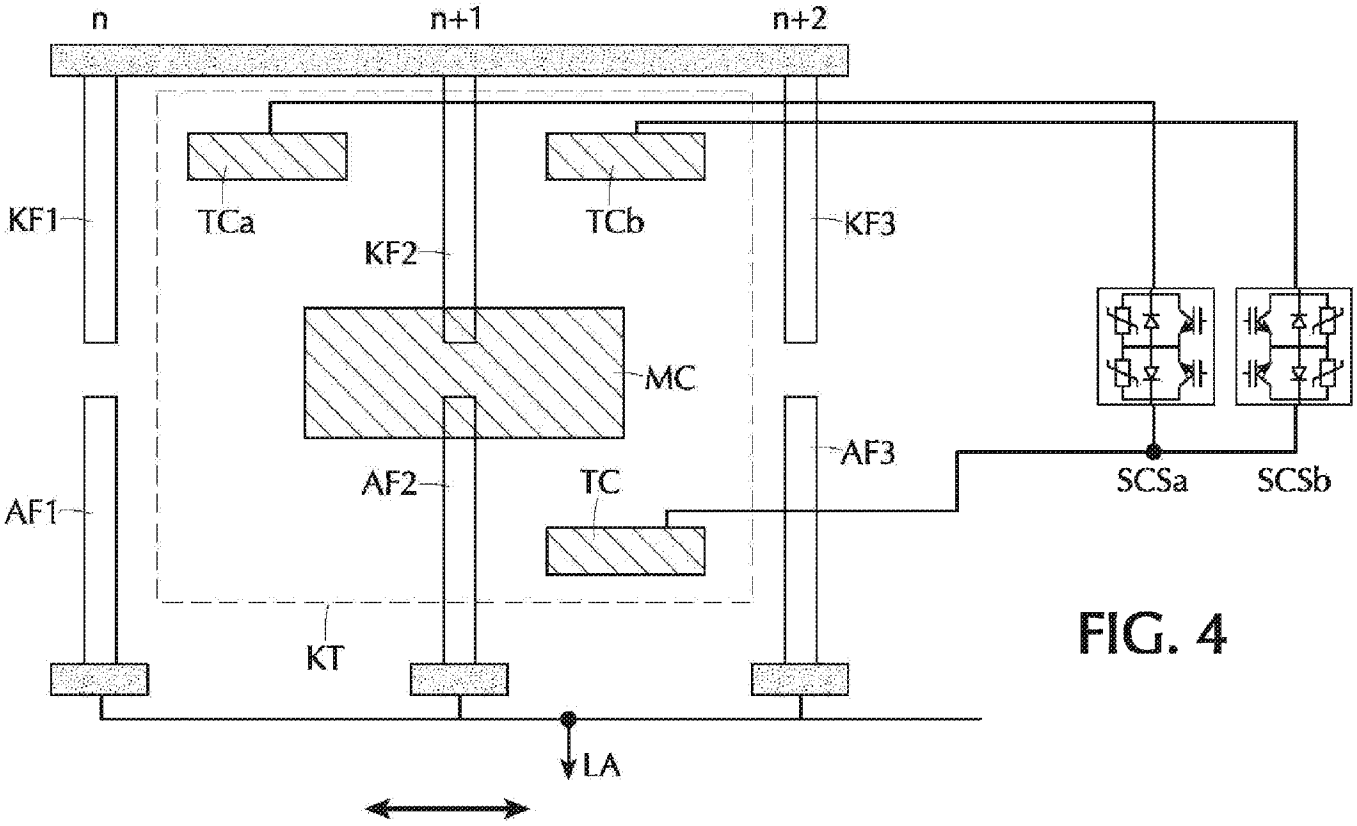
FIG. 4 shows a realization, in terms of apparatus, of a tap changer according to the invention in schematic view.

FIG. 4 shows an embodiment of the tap changer according to the invention that is schematically illustrated in FIGS. 1 and 2 and that executes the switching sequence illustrated in FIG. 3, at the time of switching.

In that regard, winding taps, here n, n+1, n+2, are again shown that are electrically connected with elongate, thin pencil-like fixed contact fingers KF1 . . . KF3. These contact fingers KF1 . . . KF3 are provided opposite respective further, similarly constructed elongate contact fingers AF1 . . . AF3 as shunt fingers that are conductively connected together and form the load shunt LA. Provided above the contact fingers KF1 . . . KF3 and AF1 . . . AF3, which lie horizontally in a plane, on both sides is a contact support KT that is here indicated by dashed lines and that is movable perpendicularly to the length direction of the contact fingers. The movement direction is again shown by an arrow.

Contact members on the contact support KT on the side facing the contact fingers KF1 . . . KF3; AF1 . . . AF3 are fixed on the contact support KT and are moved therewith in invariable geometric arrangement relative thereto. In that case, on the one hand this is the contact member MC that connects the respective winding tap directly in stationary operation—which is shown in FIG. 4—with the opposite contact finger of the load shunt LA. On the other hand, two separate further contact members TCa and TCb arranged laterally and symmetrically with respect thereto are provided. The contact member TCa is electrically connected with the input of the first semiconductor switch SCSa. The second contact member TCb is electrically connected with the input of the second semiconductor switch SCSb. Finally, a further contact member TC that is electrically connected with the output of the two semiconductor units SCSa, SCSb is also provided on the other side on the contact support KT. The described further contact members—apart from the contact member MC—are geometrically so arranged that depending on the respective switching direction, the contact member TCa or TCb temporarily contacts one of the contact fingers KF1 . . . KF3 when the contact support KT moves. The contact member TC on the other side is geometrically arranged in such a manner that it produces temporary contact with one of the contact fingers AF1 . . . AF3 of the load shunt LA during a switching process, i.e. actuation of the contact support KT. In stationary operation, all these contact members TCa, TCb, TC are not connected; the electrical connection directly from the respectively connected winding tap, here n+1, to the load shunt LA takes place exclusively by the contact member MC, whilst the entire electronic system is cleared. The construction, which is shown in this embodiment, of the contacts—which are narrow in their movement direction—as contact fingers in conjunction with the movable contacts—which are wide in the movement direction—each constructed as a contact member makes possible overall a particularly advantageous, voltage-resistant form of the tap changer according to the invention.

The designation of the described contact members in this figure corresponds with the designation of the mechanical switches in FIGS. 1 and 2, which they represent.

It is to be noted that, regardless of the construction, the circuit according to FIG. 1 or 2 and also the switching sequence according to FIG. 3 remain unchanged.

Figure 5:
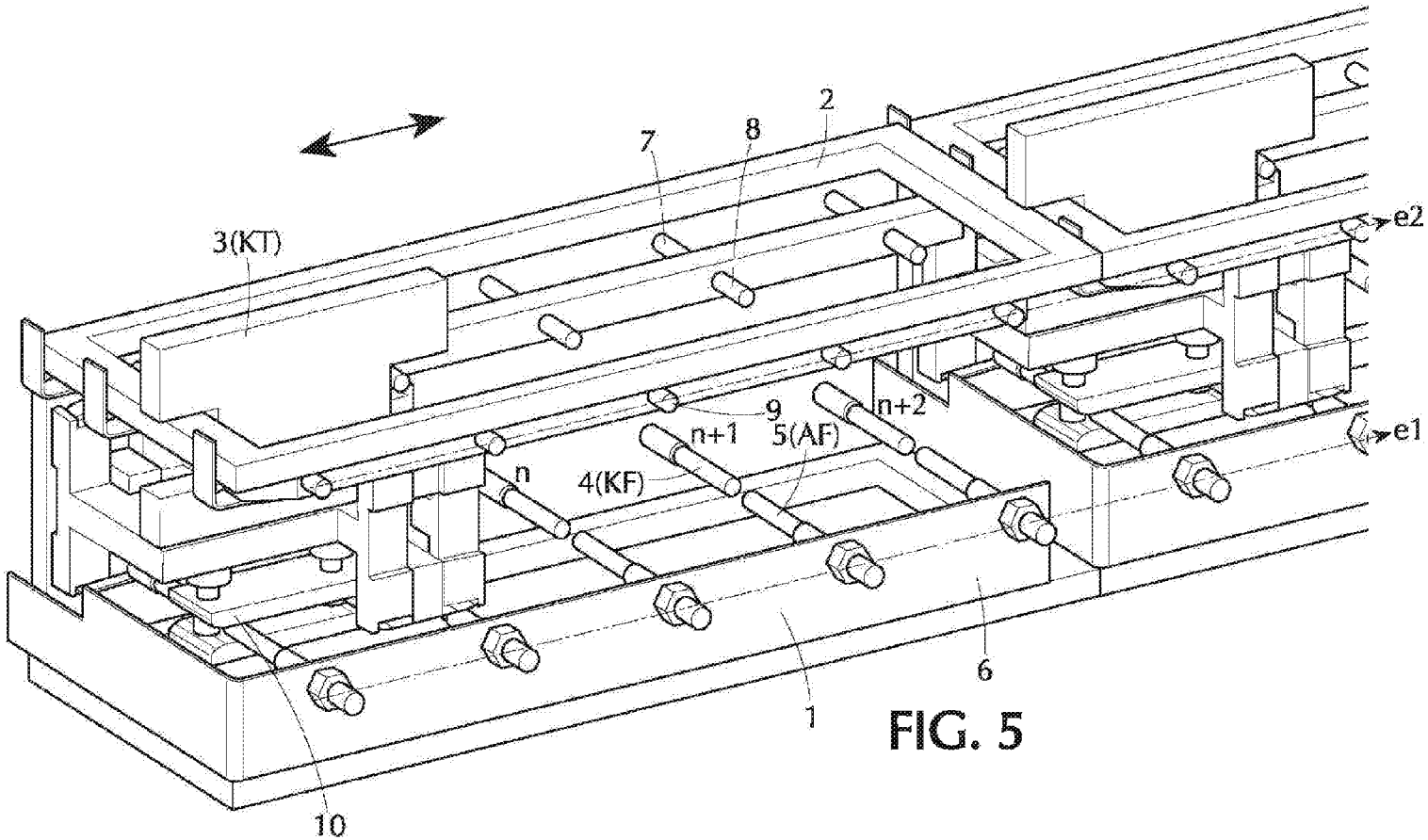
FIG. 5 shows the construction of such a tap changer according to the invention in perspective view.

FIG. 5 shows, in schematic perspective view, the construction. A housing 1 with an upper housing support 2 is shown. A contact support 3 that is linearly displaceable in longitudinal direction of the housing 1 and that was designated in FIG. 4 as KT is illustrated. The contact support 3 will be discussed in more detail below. Contact fingers 4 are provided in a first horizontal plane e1 that is indicated by a dot-dashed line and that are designated KF in FIG. 4. Further respective contact fingers 5 are arranged opposite as shunt fingers and are denoted AF in FIG. 4. All of the shunt fingers 5 are electrically connected together by a connecting plate 6 and therethrough to the load shunt. Contact fingers 7 are arranged in a second horizontal plane e2 parallel thereto and a side of the housing 1 carries further contact fingers 8 in the center on a separate support and further contact fingers 9 are provided on the other side again in the second horizontal plane e2.

It is to be noted that all the contact fingers 4, 5; 7, 8, 9 are arranged at the same grid spacing; in each instance, for reasons of clarity only one of each kind of the contact fingers is provided with a reference numeral. The contact support 3 has at its lower region a two-part main contact 10 as contact member MC that at the respectively opposite, corresponding contact finger 4 is electrically connected with the respective shunt finger 5 and thus produces in stationary operation a direct connection with the load shunt, as shown in FIGS. 1 and 2.

The contact fingers 7 are electrically connected with the input of the first semiconductor switch SCSa. The contact fingers 8 are connected with the input of the second semiconductor switch SCSb. Finally, the contact fingers 9 are electrically connected with the common output of the two semiconductor switches SCSa, SCSb.

These electrical connections are, in fact, shown in FIG. 4, but here for reasons of clarity not illustrated in FIG. 5, like the drive of the contact support 3.

Figure 6:
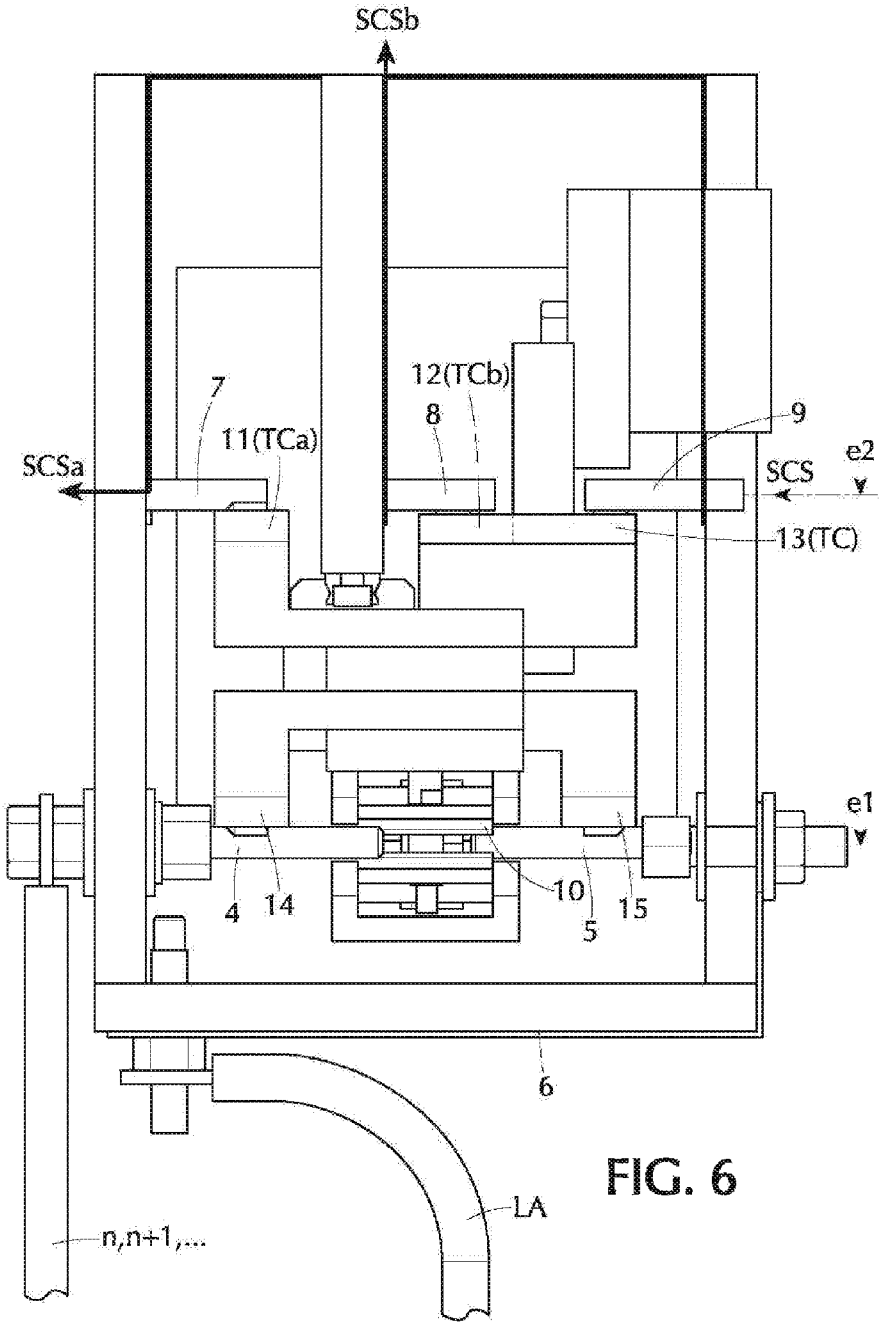
FIG. 6 shows a lateral sectional view thereof.

FIG. 6 shows this arrangement in a lateral sectional view. It can be clearly seen here that the contact fingers 4 and 5 lie in a first horizontal plane e1 and the contact fingers 7, 8, 9 in a second horizontal plane e2. It can also be seen that the contact support 3 has, apart from the described main contact 10, contact members 11, 12 and 13 that co-operate, i.e. can be connected, with the contact fingers 7 or 8 or 9, in the upper region.

The contact support 3 has at its lower part further contact members 14, 15. Contact member 14 can connect with the respective contact finger 4; contact member 15 can connect with the respective contact finger 5. It is important for the function that the contact members 11 and 12 are electrically connected with the contact member 14, whereas the contact member 13 is electrically connected with the contact member 15. The contact support 3 thus connects electrical contact members 11, 12, 13 of the upper plane e2 with contact members 14, 15 of the lower plane e1 in an entirely specific manner. In this embodiment of the invention as well, the contact fingers 4, 5; 7, 8, 9 are constructed as pencil-like contact fingers that are narrow as seen in the movement direction of the contact support and that are fastened only at one end, whereas the contact members 11, 12, 13; 14, 15 as well as the main contact 10 have a substantially larger length, preferably at least three times, in the movement direction of the contact support 3.

Figure 7:
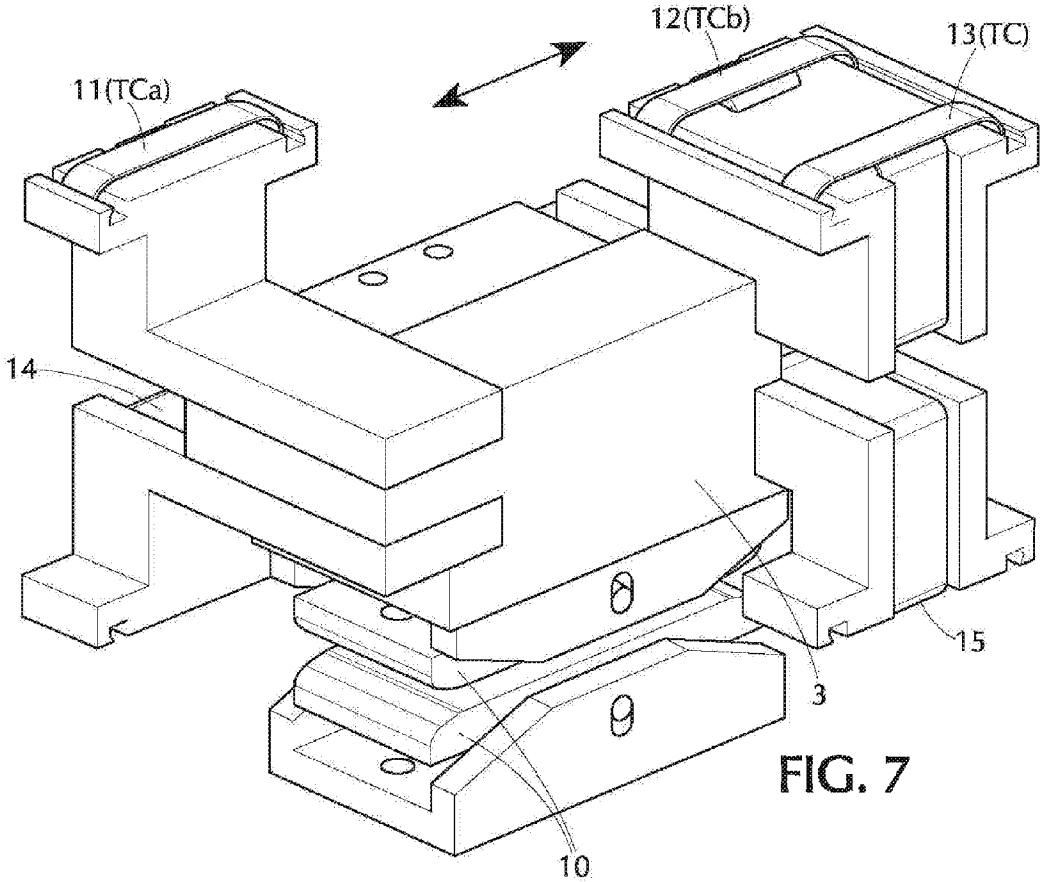
FIG. 7 shows a movable contact support of such a tap changer by itself in perspective view.

FIG. 7 shows a contact support 3 by itself in perspective view. Here at the outset the lateral contact members 14, 15 arranged in the lower horizontal plane as well as the main contact 10 can be seen. The contact members 11, 12 and 13 that are laterally offset in the movement direction (indicated by an arrow), are shown in the upper horizontal plane. The contact member 11 corresponds in its function with the contact TCa: it produces the connection with the input of the first semiconductor switch SCSa. The contact member 12 corresponds with a contact TCb: it produces the connection with the input of the second semiconductor switch SCSb. The contact member 13 corresponds with the contact TC: it produces the connection with the common output of the two is semiconductor switches SCSa, SCSb. Precisely the electrical and mechanical construction schematically illustrated in FIG. 4 is thus realized.

On movement of the contact support 3 the first or second semiconductor switch SCSa or SCSb, depending on the respective switching direction, is supplied with electrical energy by the respective contact member 11, corresponding with TCa, or 12, corresponding with TCb that is temporarily electrically connected with a fixed tap contact. The common output of the semiconductor switches SCSa and SCSb is then fed by the contact member 13, corresponding with TC, back again to the load shunt.

Here, two horizontal planes were described; it is equally also possible within the scope of the invention to orient the two parallel and vertical planes.

In summary, the function of the contact support 3 can be described in the following terms: In stationary operation it produces a direct connection of a winding tap with the load shunt in that a corresponding contact finger 4 is electrically connected with the corresponding contact finger 5 of the load shunt by the main contact 10. During switching, on the other hand, this direct contacting is interrupted and the respective semiconductor switch SCS1 or SCS2 is temporarily switched on by contact member 11 or 12 in another horizontal plane and the (common) output of that switch is fed by the further contact member 13 back again in the first horizontal plane to the contact member 15 and on to the contact finger 5 of the load shunt 6. The actual switching planes, i.e. the horizontal planes e1, are characteristic, as is the auxiliary switching plane, i.e. the plane e2, for temporary switching-on of the semiconductor switches during a switching process.

The invention claimed is:

1. A tap changer with semiconductor switching elements for uninterrupted switching between winding taps of a tapped transformer, wherein two load branches connected with the winding taps of the tapped transformer are provided that each comprise a respective mechanical main contact that in stationary operation conducts current of the respective load branch and produces an electrical connection with a load shunt, each load branch comprises parallel to the respective main contact a series circuit consisting of a further respective mechanical contact as well as a respective semiconductor switch, the semiconductor switches are electrically connected together at a side remote from the respective contacts and lead to a mechanical transfer contact whose other side is connected with the load shunt, and a connection of the main contacts as well as the further mechanical contacts is effected by a movable contact support.

2. The tap changer according to claim 1, further comprising:

fixed contact fingers parallel to one another in a first plane and are each connected with a respective winding tap of the tap changer;

similarly constructed elongate contact fingers provided oppositely in the same plane and are conductively connected together and lead to the load shunt, one such contact support is provided on side and above each of the contact fingers lying in a plane and is movable perpendicularly to a length direction of the respective contact finger;

contact members connectable with the respective contact fingers are provided on the contact support on a side directed toward the contact fingers, each contact member in stationary operation produces a direct electrical connection with the load shunt;

a further contact member electrically connected with the input of the first semiconductor switch;

a further contact member electrically connected with the input of the second semiconductor switch; and a further contact member electrically connected with a common output of the two semiconductor switches.

3. The tap changer according to claim 2, further comprising:

several further contact fingers in first, second, and third rows in a second plane, a first row of the further contact fingers being electrically connected with the input of the first semiconductor switch, a second row of contact fingers being electrically connected with the input of the second semiconductor switch, a third row of contact fingers being electrically connected with the common output of the two semiconductor switches and during a switching process contact fingers of the upper plane can be temporarily brought into electrical connection with the respective contact fingers in the first plane by the contact support by the further contact members.

4. The tap changer according to claim 2, wherein the length direction of all contact members as seen in the direction of movement of the contact support is at least three times the thickness of the contact fingers.

* * * * *